US009812829B1

(12) United States Patent
Weiden et al.

(10) Patent No.: US 9,812,829 B1
(45) Date of Patent: Nov. 7, 2017

(54) WIRING CONNECTOR FOR TWO WIRE TO TWO POINT CONNECTION

(71) Applicant: Schneider Electric USA, Inc., Andover, MA (US)

(72) Inventors: Conrad S. Weiden, Chapel Hill, NC (US); Samuel Calloway, Raleigh, NC (US); Anthony Reac Martinez Arazo, Knightdale, NC (US); Hien Nguyen, Chapel Hill, NC (US); Michael V. Maloney, Raleigh, NC (US)

(73) Assignee: Schneider Electric USA, Inc., Andover, MA (US)

( * ) Notice: Subject to any disclaimer, the term of this patent is extended or adjusted under 35 U.S.C. 154(b) by 0 days.

(21) Appl. No.: 15/348,039

(22) Filed: Nov. 10, 2016

(51) Int. Cl.

| | |
|---|---|
| ***H01R 4/36*** | (2006.01) |
| ***H01R 25/00*** | (2006.01) |
| ***H01R 4/48*** | (2006.01) |
| ***H01R 4/38*** | (2006.01) |

(52) U.S. Cl.
CPC ..... *H01R 25/003* (2013.01); *H01R 4/38* (2013.01); *H01R 4/4818* (2013.01); *H01R 4/363* (2013.01); *H01R 4/489* (2013.01)

(58) Field of Classification Search
CPC ..... H01R 4/363; H01R 4/489; H01R 4/38
See application file for complete search history.

(56) References Cited

U.S. PATENT DOCUMENTS

| | | | | |
|---|---|---|---|---|
| 4,790,778 | A * | 12/1988 | Seidenbusch | H01R 4/363 439/709 |
| 5,934,818 | A | 8/1999 | Schmitt et al. | |
| 6,719,593 | B2 | 4/2004 | Garcia et al. | |
| 7,172,470 | B2 | 2/2007 | Takaya et al. | |
| 8,393,922 | B2 * | 3/2013 | Bussieres | H01R 4/363 174/84 C |
| 8,814,607 | B2 * | 8/2014 | Da Silva | H01R 4/38 439/793 |
| 2005/0020145 | A1 * | 1/2005 | Leitl | H01R 4/2416 439/811 |

* cited by examiner

*Primary Examiner* — Tho D Ta
(74) *Attorney, Agent, or Firm* — Locke Lord LLP

(57) ABSTRACT

A small form factor wiring connector provides a two wire to two point connector with separate-hole insertion for two wires, by having two holes on the first casing side of the connector and a terminal connection on the opposite second side of the connector. The design works well for a pluggable or fixed-mounted connector. The separate wire insertion holes and the internal screw-driven clamping means with U-shaped wire clamp and U-shaped fixed terminal surfaces provides positive connections which will not easily loosen.

13 Claims, 4 Drawing Sheets

WIRING CONNECTOR FOR TWO WIRE TO TWO POINT CONNECTION

BACKGROUND OF THE INVENTION

1. Field of the Invention

The present invention relates to wire connectors and particularly to board-mounted wire connectors. The board-mounted wire connectors might be of the pluggable type, i.e. they can be removed (unplugged) from a fixed terminal on a circuit board, or the wire connector might be directly fixed to the circuit board.

2. Discussion of the Related Art

There is often a need for wires to be joined mechanically for electrical continuity. Wire connectors that allow the wires to rest on top of one another by insertion into a single port on the connector are not always desirable for reasons of potentially reduced conductivity and/or wire retention capability. Ease of wire insertion into the terminal may also be compromised in these arrangements.

When wires rest on top of each other at the same connection point, the probability that the connection will lose clamping force overtime causing loose connections is increased. Especially with thicker wire insulations and larger wire gauges a secure connection can be difficult to make in the first instance in this situation.

Thus there is a need for easier and more secure wiring connections, especially in the case of known small form factor pluggable or fixed-mounted wire connectors, such as for the typical 5.08 mm wide connector, where two wires are attached at one port.

SUMMARY OF THE INVENTION

This invention provides a fixed-mounted or pluggable wiring connector that easily allows two wires to be inserted along the same axis, e.g. "vertical," and secured by a single screw so as to minimize the perpendicular axis dimension, e.g. "horizontal," of the connector. By allowing separate wire openings (sometimes known as "ports") for each wire, the connection is more secure and easier to make than what might be found in typical 5.08 wide pluggable wire connectors where two wires are inserted and secured in one opening (i.e. port).

In various aspects of the invention a wiring connector for two wire to two point connection, comprises: a.) a metallic connector body rectangular shape forming a first interior area, and interior wall forming second interior area, and having a threaded through-hole in a first end wall thereof; b.) a clamping screw having a first end drive head and a second end pressing point and a non-threaded slot portion on its threaded body, the clamping screw attached to the connector body through the threaded through-hole, c.) a conductive fixed terminal within the first interior area of the connector body, the fixed terminal having a U-shape that allows for first and second wire contact surfaces; the fixed terminal further having an extension member extending from the U-shape for connection to a circuit; d.) a wire clamp inside the connector body attached to the clamping screw and translatable through the interior area of the connector body by contact with the clamping screw and the wire clamp having a surface facing the fixed terminal; the clamping screw further attached to the connector wire clamp through the non-threaded slot portion; e.) a spring form inside the U-shape of the fixed terminal that biases the U-shape outwardly and provides a level of pressure on an inserted wire so as to insure proper electrical connection between the wires and the fixed terminal; and f.) a nonconductive housing surrounding the connector body and having first and second wire holes on a first side of the housing and a terminal hole on a second side of the housing for allowing access to the extension member; g.) and whereby: the wire connections are made by inserting one wire through each wire hole and into the connector body and against each wire contact surface of the fixed terminal; tightening the clamping screw through a top hole of the nonconductive housing so as to apply appropriate clamping pressure on the fixed terminal and each wire via the wire clamp and against the interior wall of the connector body.

The wiring connector for two-wire separate-hole insertion in some aspects may further comprise: a plastic shield inserted at least partially into the second interior area of the connector body and having a surface for blocking the second wire hole of the nonconductive housing. In other aspects the wiring connector for two-wire separate-hole insertion may further comprise: the wire clamp having a shield surface for blocking the first wire hole of the nonconductive housing. In other aspects the wiring connector for two-wire separate-hole insertion may include the wire clamp shield surface being metal. In other aspects the wiring connector for two-wire separate-hole insertion may include the wire clamp being metal. In other aspects of the present invention the nonconductive housing may include a screw hole for allowing access to the drive head of the clamping screw. In other aspects one or more of the wire clamp, the connector body, and the spring form, may be conductive. In other aspects the fixed terminal may comprise a one piece folded member.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION

Figure 1:
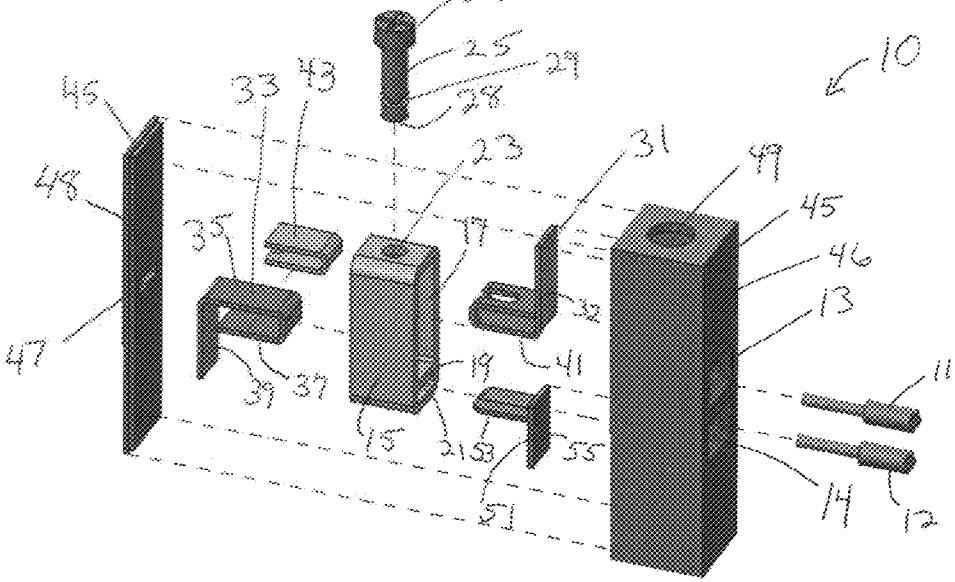
FIG. 1 is an exploded view of an exemplary embodiment of a two wire to two point connector.
Figure 2:
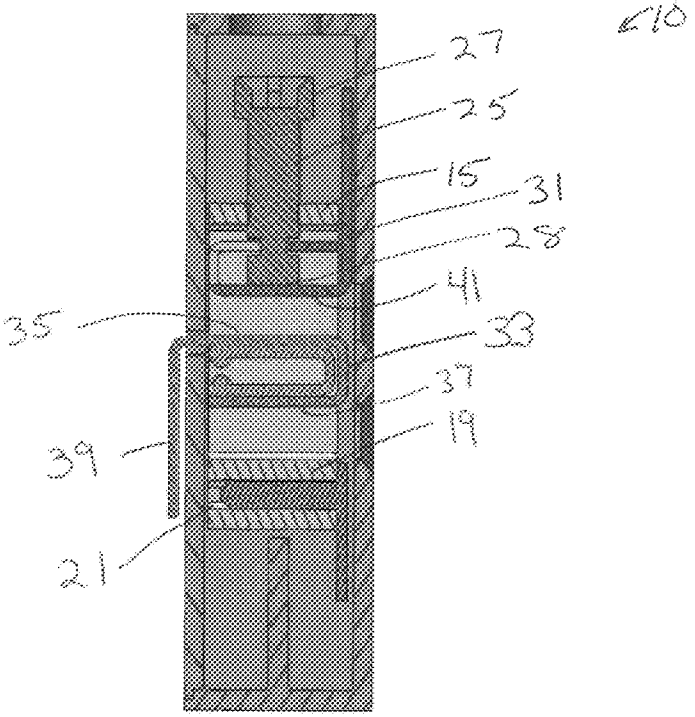
FIG. 2 is a cross section of the exemplary embodiment with no wires attached.

As an initial matter, it will be appreciated that the development of an actual commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top,"

"bottom," "left," "right," "upper," "lower," "down," "up," "side," and the like, used in the written description are for clarity in specific reference to the drawings and are not intended to limit the scope of the invention.

As seen in the Figures, a wiring connector 10 is illustrated in both exploded view and cross sections. The wiring connector 10 is a single port for a first wire 11 and second wire 12 to be inserted via separate first and second holes, 13 and 14, respectively, and joined in electrical continuity.

The wiring connector 10 comprises a connector body 15, preferably extruded or formed metal, of rectangular shape forming a first interior area 17, and with an interior wall 19 forming second interior area 21, and having a threaded through-hole 23 in a first end wall thereof.

A clamping screw 25 passes through the threaded through-hole 23 and has a first end drive head 27 and a second end pressing surface 28 and a non-threaded slot portion 29 on its threaded body connecting the clamping screw 25 to a wire clamp 31 as further explained below.

A conductive fixed terminal 33 is located within the first interior area of the connector body 15, the fixed terminal 33 having a U-shape that allows for a first wire contact surface 35 and second wire contact surface 37 with electrical continuity; the fixed terminal 33 further having an extension member 39 extending from the U-shape for connection to a circuit (not shown).

The wire clamp 31 is located inside the connector body 15 and is attached to the clamping screw 25 and is translatable through the interior area of the connector body 15 by contact with the clamping screw 25 with the wire clamp 31 having a surface 41 facing the first wire contact surface 35 of the fixed terminal 33 and a shield surface 32 facing the first wire hole 13. The clamping screw is attached to the connector wire clamp 31 through the non-threaded slot portion 29. The wire clamp 31 is preferably metallic for its physical properties such as surface hardness, but need not be conductive.

Figure 3:
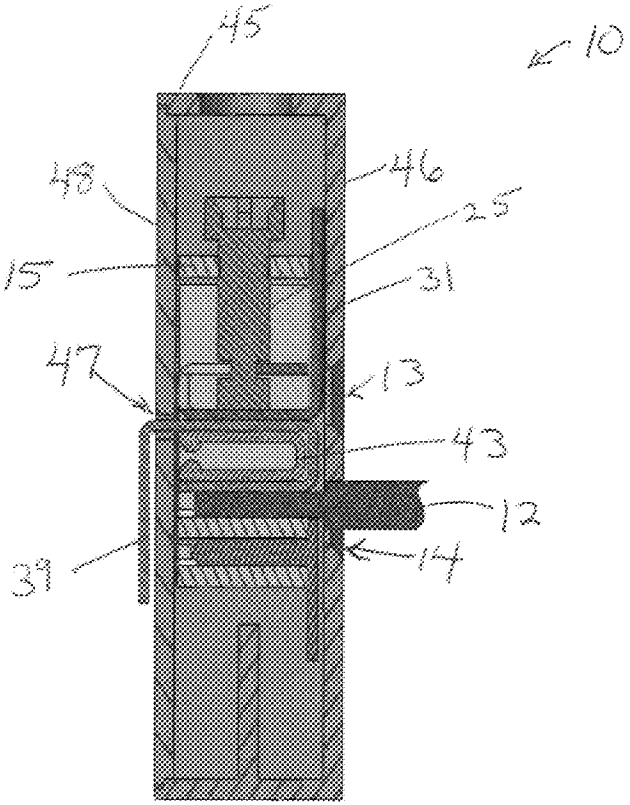
FIG. 3 is a cross section of the exemplary embodiment with one wire attached.
Figure 4:
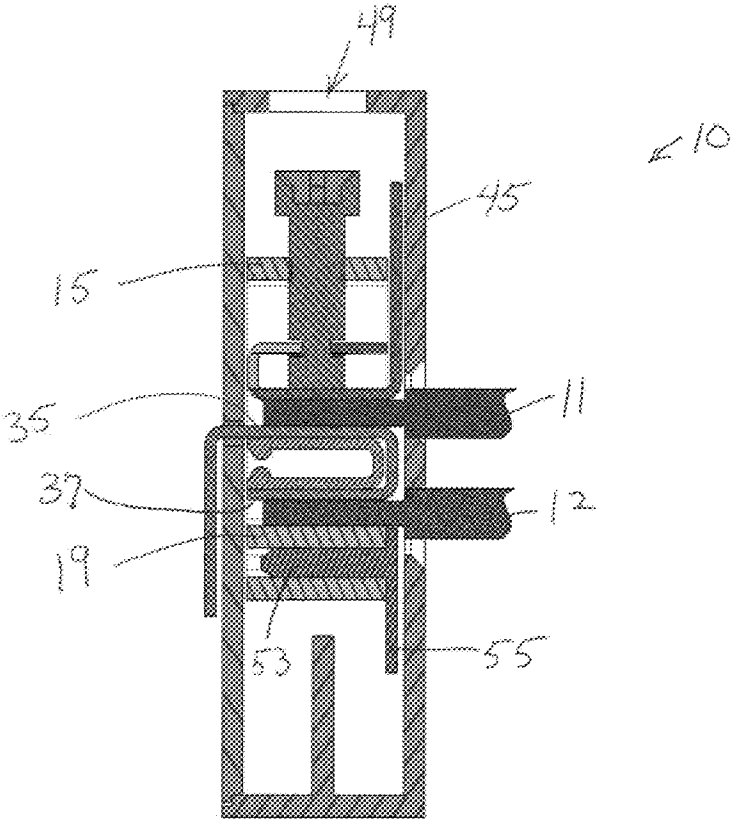
FIG. 4 is a cross section of the exemplary embodiment with two wires attached.

A U-shaped spring form 43 is located inside the U-shape of the fixed terminal 33 and biases the two contact surfaces 35, 37 of the U-shape of the fixed terminal 33 outwardly and provides a level of pressure on an inserted wire (FIGS. 3 and 4) so as to insure proper electrical connection between the wires and the fixed terminal 33.

A nonconductive housing 45 surrounds the connector body 15 and has the first and second wire holes 13, 14 on a first side 46 of the housing 45 and a terminal hole 47 on a second side 48 of the housing 45, shown as a separate panel, for allowing access to the extension member 39.

Thus, the wire connections are made by inserting one wire each 11, 12 through the holes 13, 14 of the housing 45 and into the connector body 15 and against each wire contact surface 35, 37 of the fixed terminal 33. The clamping screw 25 is then tightened through a top hole 49 of the housing 45 so as to apply appropriate clamping pressure on the fixed terminal 33 and each wire 11, 12 via the wire clamp 31 and the interior wall 19 of the connector body 15. It will of course be appreciated upon understanding all aspects of the invention that more than one wire might be put into each port if the end user were to desire this.

A plastic shield 51 is inserted with a first leg 53 at least partially into the second interior area 21 of the connector body 15 and has a perpendicular leg 55 for blocking the second wire hole 14 of the nonconductive housing 45.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the invention as defined in the appended claims.

The invention claimed is:

1. A wiring connector for two wire to two point connection, comprising:

a) a connector body having a first interior area, an interior wall forming a second interior area, and a threaded through-hole in a first end wall thereof;

b) a clamping screw having a first end drive head and a second end pressing point and a non-threaded slot portion on its threaded body, the clamping screw attached to the connector body through the threaded through-hole, c) a conductive fixed terminal located within the first interior area of the connector body, the fixed terminal having a U-shape that allows for first and second wire contact surfaces; the fixed terminal further having an extension member extending from the U-shape for connection to a circuit;

d) a wire clamp located inside the connector body and attached to the clamping screw and translatable through the first interior area of the connector body by contact with the clamping screw and the wire clamp having a surface facing the fixed terminal; the clamping screw further attached to the wire clamp through the non-threaded slot portion;

e) a spring form located inside the U-shape of the fixed terminal that biases the U-shape outwardly and provides a level of pressure on inserted wires so as to insure proper electrical connection between the inserted wires and the fixed terminal; and f) a nonconductive housing surrounding the connector body and having first and second wire holes on a first side of the housing and a terminal hole on a second side of the housing for allowing access to the extension member;

g) whereby: wire connections are made by inserting each of the inserted wires through the first wire hole and the second wire hole, respectively, and into the connector body and against each of the first and the second wire contact surfaces of the fixed terminal, respectively; tightening the clamping screw so as to apply appropriate clamping pressure on each of the first and the second wire contact surfaces of the fixed terminal and each of the inserted wires via the surface of the wire clamp and the interior wall of the connector body.

2. The wiring connector for two wire to two point connection according to claim 1, further comprising: a plastic shield inserted at least partially into the second interior area of the connector body and having a surface for blocking the second wire hole of the nonconductive housing.

3. The wiring connector for two wire to two point connection according to claim 1, further comprising: the wire clamp having a shield surface for blocking the first wire hole of the nonconductive housing.

4. The wiring connector for two wire to two point connection according to claim 3 wherein the wire clamp shield surface is metal.

5. The wiring connector for two wire to two point connection according to claim 1 wherein the wire clamp is metal.

6. The wiring connector for two wire to two point connection according to claim 1 wherein the nonconductive housing includes a screw hole for allowing access to the drive head of the clamping screw.

7. The wiring connector for two wire to two point connection according to claim 1 wherein the wire clamp is conductive.

8. The wiring connector for two wire to two point connection according to claim 1 wherein the connector body is conductive.

9. The wiring connector for two wire to two point connection according to claim 1 wherein the spring form is metallic.

10. The wiring connector for two wire to two point connection according to claim 1 wherein the fixed terminal is a one piece folded member.

11. The wiring connector for two wire to two point connection according to claim 1 wherein the spring form has a U-shape.

12. The wiring connector for two wire to two point connection according to claim 1 wherein the connector body is metallic.

13. The wiring connector for two wire to two point connection according to claim 1 wherein the connector body is rectangular.

* * * * *